United States Patent [19]

Collins

[11] 4,378,514

[45] Mar. 29, 1983

[54] STARTING AND OPERATING CIRCUIT FOR GASEOUS DISCHARGE LAMPS

[75] Inventor: Byron R. Collins, Hendersonville, N.C.

[73] Assignee: General Electric Company, Schenectady, N.Y.

[21] Appl. No.: 201,014

[22] Filed: Oct. 27, 1980

[51] Int. Cl.[3] ..... H05B 41/29

[52] U.S. Cl. ..... 315/276; 315/225; 315/239; 315/278; 315/290; 315/309; 315/DIG. 7

[58] Field of Search ..... 315/119, 225, 239, 276, 315/278, 289, 290, 309, DIG. 2, DIG. 7; 331/65

[56] References Cited

U.S. PATENT DOCUMENTS

| | | | |
|---|---|---|---|
| 3,699,385 | 10/1972 | Paget | 315/225 X |
| 3,740,609 | 6/1973 | Moerkens | 315/DIG. 5 |
| 3,758,818 | 9/1973 | Kaneda | 315/290 X |
| 3,944,876 | 3/1976 | Helmuth | 315/289 X |
| 4,048,539 | 9/1977 | Walker et al. | 315/239 X |
| 4,087,723 | 5/1978 | Chermin | 315/DIG. 7 |
| 4,177,403 | 12/1979 | Remery | 315/309 X |

*Primary Examiner*—Eugene La Roche

*Attorney, Agent, or Firm*—Ernest W. Legree; Philip L. Schlamp; Fred Jacob

[57] ABSTRACT

Starting and operating circuit for gaseous discharge lamps has device for quickly re-starting extinguished lamps while still hot. Circuit comprises a source of alternating current, an inductive regulator ballast having its input connected to the alternating current source, and a gaseous discharge lamp connected to the output of the ballast, a sine wave oscillator circuit having its input connected to the current supply and having its output connected to a transformer connected in series between the ballast and the lamp for stepping up and applying voltage to a lamp, and a positive temperature coefficient resistor (PTCR) connected between the alternating current source and the oscillator circuit for reducing power to the oscillator circuit when the lamp is inoperative or absent.

7 Claims, 2 Drawing Figures

STARTING AND OPERATING CIRCUIT FOR GASEOUS DISCHARGE LAMPS

The present invention relates to discharge lamp starting and operating circuits, and particularly concerns such circuits for quickly re-starting extinguished high intensity gaseous discharge lamps while still hot.

Known types of circuits for starting and ballasting high intensity discharge lamps have the disadvantage that when power is briefly removed from the system, the lamp rapidly de-ionizes and ceases to conduct current upon re-application of power. The temporary outage may last from 1 minute up to as much as 15 minutes depending on lamp type and cause interruption of work operations or other activities until the lamp is re-started. In the past, various devices for quickly re-starting the lamp have been suggested, but known devices and circuits of this type have generally been expensive, complicated in structure or unreliable in operation.

It is object of the invention to provide an improved device for starting and operating gaseous discharge lamps.

A particular object of the invention is to provide a device of the above type for quickly re-starting extinguished discharge lamps while still hot.

Another object of the invention is to provide a device of the above type comprising a starting circuit wherein provision is made for automatically reducing power applied to the starting circuit when the lamp is inoperative or absent.

A further object of the invention is to provide a device of the above type wherein the starting circuit automatically ceases operation when the lamp turns on and automatically begins operation when the lamp is extinguished.

Still another object of the invention is to provide a device of the above type which is simple in construction, relatively low in cost, and is efficient and reliable in operation.

Other objects and advantages will become apparent from the following description and the appended claims.

With the above objects in view, the present invention in one of its aspects relates to a starting and operating circuit for gaseous discharge lamps comprising, in combination, a source of alternating current, inductive ballast means connected at its input side to the alternating current source, discharge lamp means connected to the output side of the ballast means, transformer means connected in series between the discharge lamp means and the ballast means, sine wave oscillator means connected at its input side to the alternating current source and at its output side to the transformer means whereby the transformer means steps up and applies to the discharge lamp means sine wave voltage produced by the oscillator means for starting and re-starting the discharge lamp means, and variable impedance means connected between the alternating current source and the oscillator means for reducing power to the oscillator means when the discharge lamp means has been started or is inoperative.

Figure 1:
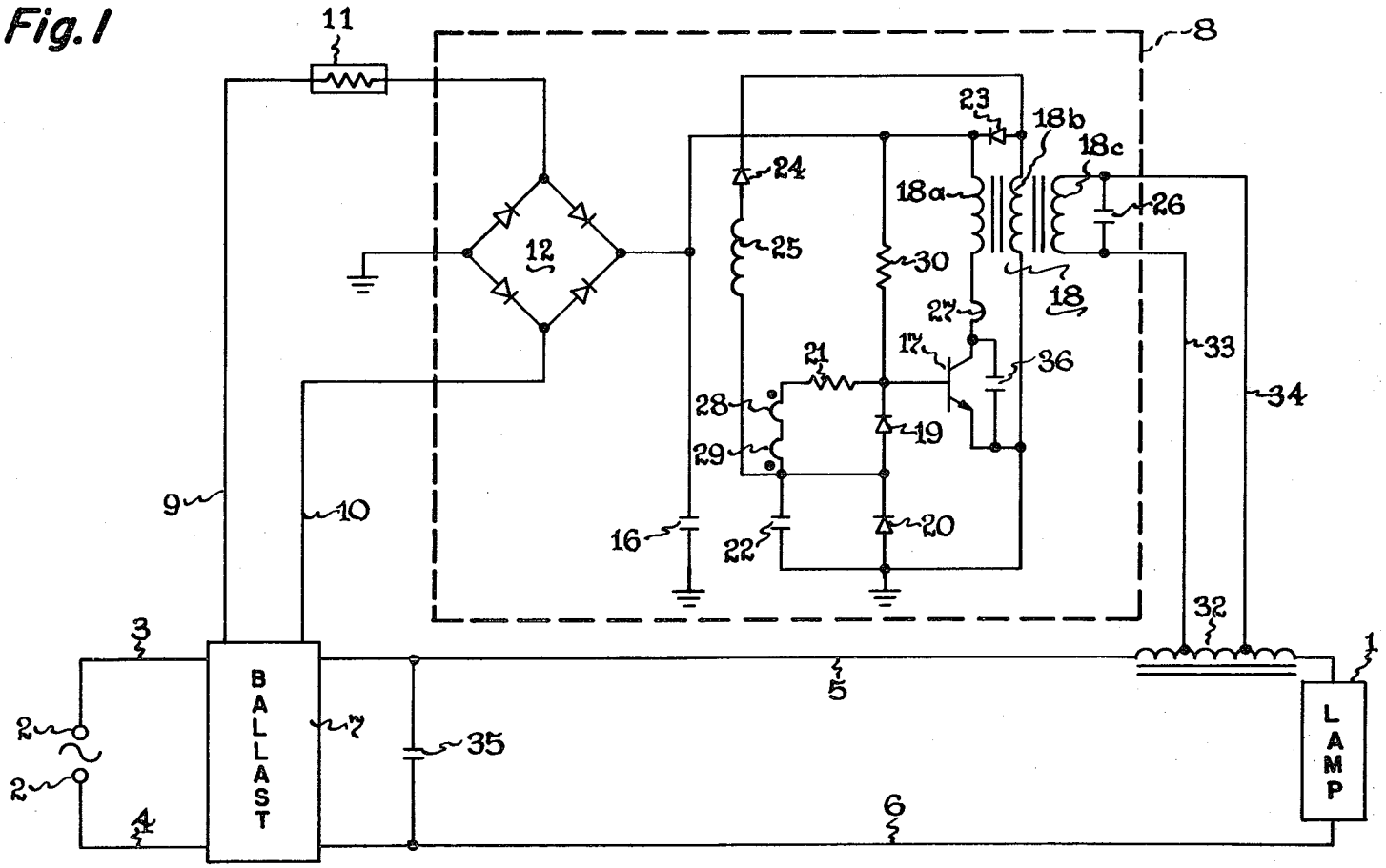
Figure 2:
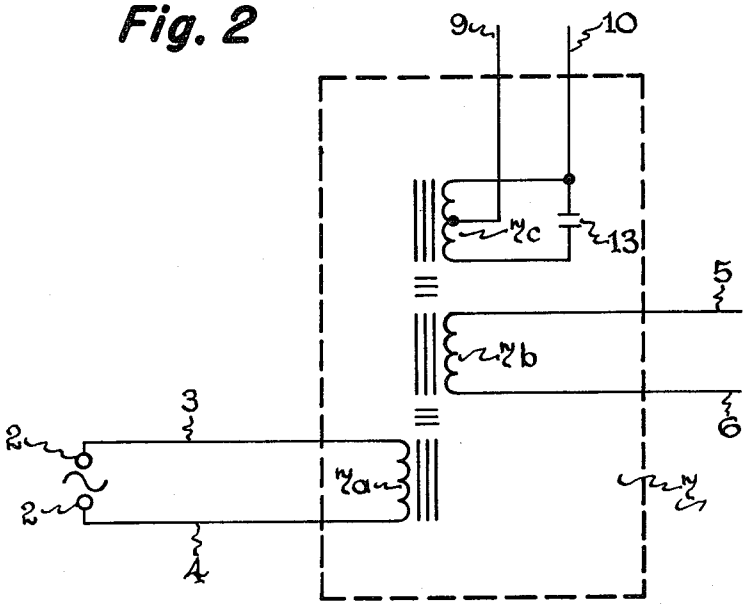

The invention will be better understood from the following description taken in conjunction with the accompanying drawings, in which:

FIG. 1 is a circuit diagram of a discharge lamp starting and operating circuit in accordance with an embodiment of the invention; and FIG. 2 is a circuit diagram of a regulator ballast which may be employed in the circuit of FIG. 1.

Referring now to the drawings, and particularly to FIG. 1, there is shown a starting and operating circuit for a high intensity gaseous discharge lamp 1, typically a high pressure sodium vapor lamp or other discharge lamp, which requires a relatively high voltage pulse in order to be ignited and which thereafter operates on a lower voltage. Lamp 1 is connected by conductors 5 and 6 to the output of ballast 7 which in turn is connected to terminals 2 of an alternating current source, typically 120 volts. Ballast 7, which may be any of known types of inductive ballast devices, provides current limiting impedance as is conventional in discharge lamp circuits. A preferred type is a magnetic regulator ballast such as shown in detail in FIG. 2 and described more fully below.

The ballast transformer shown in FIG. 2 comprises primary winding *7a* connected across supply terminals 2, secondary winding *7b* connected by conductors 5 and 6 to the discharge lamp, and tertiary winding *7c* connected as shown to the oscillator circuit by conductors 9 and 10, with regulating capacitor 13 connected in series with tertiary winding *7c*, so as to regulate the output of the oscillator within desired limits.

In accordance with the invention, a sine wave oscillator circuit is employed to provide a high voltage high frequency sine wave, e.g., in the range of 1600 to 200,000 Hz, for not only starting lamp 1 when cold but also for quickly re-starting the extinguished lamp while still hot, and there is further provided variable impedance means for reducing the voltage applied to the oscillator circuit should the lamp be inoperative or be absent. For these purposes there is provided in the embodiment shown in FIG. 1, sine wave oscillator circuit 8 connected by conductors 9 and 10 to ballast 7 as shown and variable impedance means in the form of a positive temperature coefficient resistor (PTCR) 11 connected in series between ballast 7 and oscillator circuit 8. As well understood in the art, the PTCR has low resistance when cool and as it gradually heats up due to passage of current therethrough, its resistance correspondingly increases. The particular oscillator circuit illustrated is, in its main construction, of known type, being shown, for example, in U.S. Pat. No. 4,202,031—Hesler et al, (see particularly FIGS. 1 and 7 of the patent and the description relating thereto), the patent being assigned to the same assignee as the present invention. Oscillator circuit 8 comprises full wave rectifier 12 serving as a direct current source, filter capacitor 16, power transistor 17, transformer 18, diodes 19 and 20, resistors 21 and 30 and capacitor 22, the circuit components being connected as shown to provide for turning on and controlling the operation of the transistor, and the combination functioning as a sine wave oscillator. Transformer 18 comprises primary winding 18*a*, demagnetizing winding 18*b* and secondary winding 18*c*, the latter winding, in accordance with the invention, being connected by conductors 33 and 34 to a coupling transformer 32, such as the autotransformer shown, connected to conductor 5 in series with lamp 1. Capacitor 36 connected across transistor 17 serves to assure proper transistor commutation over widely ranging load conditions. Transformer 18 also comprises three feedback windings 27, 28, 29 which serve to control the operation of transistor 17. The base of transistor 17 is connected to a starting and control network comprising resistor 30, diodes 19 and 20, feedback windings 28, 29, resistor 21 and capacitor 22. Diode 23 connected to windings 18*a*, 18*b* serves to protect transistor 17 from high voltage surges.

Further details of the elements, arrangement and operation of oscillator circuit 8 are set forth in the aforementioned Hesler et al patent, and the description thereof is accordingly incorporated herein by reference.

In the illustrated embodiment, a turn off mechanism comprising series connected diode 24 and inductor 25 is provided in the oscillator circuit for turning off the oscillator as more fully described below. The particular turn-off mechanism illustrated, which is not a part of the present invention, is disclosed and claimed in co-pending application Ser. No. 201,013—Owen, filed Oct. 27, 1980, and assigned to the same assignee as the present invention. As there disclosed, the turn-off mechanism comprises series-connected diode 24 and inductor 25 connected at one side to the junction of the anode of diode 23 and transformer demagnetizing winding 18*b*, and at the other side to the junction of base feedback winding 29 and capacitor 22. This device stops operation of the oscillator during normal lamp operation without interfering with normal restarting functions. This is accomplished with the illustrated circuit by supplying a negative current to capacitor 22 which is greater in magnitude than the positive charging current supplied to capacitor 22 through resistor 30. The described turn-off circuit utilizes the high voltage transformer 32 as a lamp current sensor during lamp operation. Transformer 32, which steps up the high frequency voltage to start the lamp is designed to saturate with the 60 Hz lamp current during normal lamp operation to minimize its interference with lamp current. However, normal transformer action takes place until the current waveform reaches a magnitude sufficient to saturate the core. This produces a 60 Hz voltage on the normal primary of transformer 32. This voltage, being applied to transformer secondary winding 18*c*, induces a voltage reduced by turns ratio in the other windings of transformer 18. In accordance with the present invention, this voltage is rectified to obtain a negative voltage and filtered, and is employed to turn off transistor 17.

Inductor 25 serves as a high frequency blocking filter to prevent the high frequency restart voltage from turning off transistor 17. Diode 24 serves to block the positive pulse and pass the negative pulse, so as to produce a negative bias to the transistor base for shutting off the transistor.

In the operation of the disclosed circuit, when the circuit is energized, capacitor 16 charges up through PTCR 11 and rectifier bridge 12. During such charging of capacitor 16, PTCR 11 has a current limiting function. After capacitor 16 is fully charged, the oscillator circuit turns on as hereinafter explained. The RC time constant for capacitor 16 and PTCR 11 is very short, and accordingly capacitor 16 becomes fully charged very quickly, e.g., within one cycle. For oscillator circuit 8 to turn on, capacitor 22 must charge up to a small positive value, such charging being controlled by the RC constant of resistor 30 and capacitor 22 and requiring a number of cycles. The charging capacitor 22 biases the base of transistor 17 positive, and the transistor turns on with the collector current flowing through transformer winding 18*a*. Feedback windings 28, 29 generate a negative voltage which turns off transistor 17. The energy stored in transformer 18 is then reduced when current flows through the demagnetizing winding 18*b* of the transformer and diode 23. Oscillator 8 thus becomes free running, as described in further detail in the aforementioned Hesler et al patent, and the output of transformer 18 is a high frequency sine wave. The voltage is then stepped up by coupling autotransformer 32 for application to lamp 1.

Capacitor 35 connected across ballast 7 offers very low impedance to the high voltage generated by transformer 32, and hence very little of the high frequency voltage appears across the ballast.

If lamp 1 starts, the oscillator circuit is turned off by operation of diode 24 and inductor 25, as described previously. Normal starting of a cold lamp is thus provided.

If lamp 1 becomes extinguished due to a dip in the line voltage, the turn off mechanism of diode 24 and inductor 25 ceases to function as a result of a lack of lamp current through transformer 32. Then, since capacitor 16 is still fully charged, it starts to re-charge capacitor 22, which had been held with a small negative charge by the turn-off network, so that a small positive charge is again placed on capacitor 22 and the previously described procedure is repeated for starting lamp 1.

In the event lamp 1 is absent or inoperative, oscillator circuit 8 becomes partially disabled after a predetermined period of operation. This occurs by PTCR 11 becoming heated and presenting a high resistance, thus limiting the output power of the oscillator because capacitor 16 does not become fully charged.

Capacitor 26 shown connected across transformer secondary winding 18*c* forms a resonant circuit with the latter winding and the primary of autotransformer 32, and serves to control the frequency of the sine wave oscillator to the desired level.

While PTCR 11 is shown connected between ballast 7 and rectifier 12, it may in another preferred embodiment be connected instead between rectifier 12 and transformer primary winding 18*a*.

While oscillator circuit 8 is shown connected to supply terminals 2, 2 via ballast 7, it will be understood that it may be directly connected to the supply terminals, or it may be connected to a separate supply source in appropriate conditions.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. A starting and operating circuit for gaseous discharge lamps comprising, in combination, a source of alternating current, inductive ballast means connected at its input side to said current source, discharge lamp means connected to the output side of said ballast means, first transformer means connected between said discharge lamp means and said ballast means, sine wave oscillator means connected at its input side to said current source, said oscillator means including second transformer means comprising a plurality of magnetically coupled windings whose output side is connected to said first transformer means whereby said first transformer means steps up and applies to said discharge lamp means sine wave voltage produced by said oscillator means for starting and re-starting said discharge lamps means, and variable impedance means connected between said current source and said oscillator means for reducing power to said oscillator means when said discharge lamp means is inoperative or absent.

2. A circuit as defined in claim 1 including rectifier means connected between said current source and said oscillator means.

3. A circuit as defined in claim 1 including rectifier means connected between said current source and said oscillator means, said variable impedance means comprising a positive temperature coefficient resistor.

4. A circuit as defined in claim 1, said ballast means being a regulator ballast comprising a primary winding connected to said current source, a secondary winding connected to said discharge lamp means, and a tertiary winding connected to said oscillator means.

5. A circuit as defined in claim 1 including rectifier means connected between said current source and said oscillator means, said oscillator means comprising controlled switch means and a turn-off circuit therefor activated through a winding of said second transformer means when normal current flows through said lamp means, and said variable impedance means comprising a positive temperature coefficient resistor which heats up in the event of prolonged failure to start said lamp means and thereby reduces power supplied to said oscillator means.

6. A circuit as defined in claim 1 including a capacitor connected across said second transformer means at the output side for controlling the frequency of said oscillator means.

7. A circuit as defined in claim 1, said oscillator means comprising controlled switch means connected to said second transformer means for providing high frequency voltage pulses for starting and restarting said discharge lamp means.

* * * * *